United States Patent [19]

Schweitzer et al.

[11] 4,319,536

[45] Mar. 16, 1982

[54] BOOM ATTACHING MECHANISM

[75] Inventors: Henry H. Schweitzer, 317 Beirut, Pacific Palisades, Calif. 90272; Thane H. Roberts, Santa Monica, Calif.

[73] Assignee: Henry Hoyle Schweitzer, Torrance, Calif.

[21] Appl. No.: 148,882

[22] Filed: May 12, 1980

[51] Int. Cl.[3] ..... B63B 15/00

[52] U.S. Cl. ..... 114/99; 114/218

[58] Field of Search ..... 9/310 E; 114/39, 90, 114/91, 97-100, 108, 102, 199, 218; 24/115 R; 43/44.9, 44.91; 211/60 R, 60 G

[56] References Cited

U.S. PATENT DOCUMENTS

| | | | |
|---|---|---|---|
| 2,556,932 | 6/1951 | Morrissey | 43/44.91 |
| 2,570,293 | 10/1951 | Vadnais | 43/44.91 |
| 3,012,359 | 12/1961 | Foster | 43/44.91 |
| 3,956,785 | 5/1976 | Halfon | 114/218 |
| 4,176,752 | 12/1979 | Taber | 211/60 G |

*Primary Examiner*—Sherman D. Basinger

*Attorney, Agent, or Firm*—Nilsson, Robbins, Dalgarn, Berliner, Carson & Wurst

[57] ABSTRACT

A spar-end boom fitting, comprising a first and a second boom receiving member each having a boom receiving bore therein and each being joined by a connecting member with the connecting member forming with the boom receiving members a spar-receiving indentation and having a first and a second lashing line passage therethrough, and a jam cleat formed radially along the outer circumference of one of the boom receiving members, including a groove, having a pair of opposed rows of teeth. In addition it is disclosed that the boom receiving members have a plurality of parallel radially outward extending ribs and an interconnecting longitudinally outward extending spine and the groove is formed between a pair of the ribs. Further the disclosure includes the spar receiving indentation being covered with a resilient foam material which will conform to the shape of the spar. Still further, the disclosure includes an up-haul line locking mechanism formed in the connecting member.

6 Claims, 4 Drawing Figures

BOOM ATTACHING MECHANISM

BACKGROUND AND SUMMARY OF THE INVENTION

Wind propelled vehicles having a body means, which may be, e.g., a surf board, adapted to support a user, and a pivotally attached wind propulsion means mounted on a spar attached to the vehicle by, e.g., a universal joint, and having a pair of curved booms athwart the spar to contain the sail and provide a hand hold for the user of the vehicle, are well known in the art as shown in the patent to Schweitzer et al, U.S. Pat. No. 3,487,800.

In the past, it has been common to attach the spar ends of the booms to the spar by a reinforced tape which is attached to each boom and runs on either side of the spar to engage the spar in a pocket formed between the tape extending across the forward part of the spar and the tape extending across the aft part of the spar. In addition, the juncture of the two booms has been formed with an attached D-ring through which a lashing line can be passed to lash the booms to the spar. Further, as shown in the article by Cullin Terry entitled Windsurfer Booms appearing at page 8 of *Windsurfer Magazine,* Volume 9, Number 2, Fall 1979, shows a boom fitting having a pair of cylindrical boom receiving members each having an open end and a closed end, with the closed ends joined by a generally D-shaped thin connecting member having a large centrally located lashing line passage and a smaller and off center lashing line passage aligned with the longitudinal axis of one of the boom receiving members, and with that some boom receiving member having a jam cleat extending longitudinally outward from the outer surface thereof. In operation, this boom fitting is attached to the spar by a lashing line which is made fast at one end to the spar and passed through the large centrally located line passage, looped around the spar and passed through the smaller line passage and into the jam cleat, with the boom fitting being tightened to the spar by pulling the lashing line through the jam cleat to pull the spar as tightly as possible between the boom receiving members. This boom fitting shown in the prior art is constructed of a molded plastic including the region where the spar contacts the outer surfaces of the boom receiving members when the boom fitting is tightened to the spar. In operation, since the booms provide a hand hold means for the user of the vehicle, and a means for setting the angle of attack of sail to the wind direction, the boom fitting will rotate about the spar and at the same time the spar will tend to slide along the surface of the boom receiving member so that the boom fitting becomes cocked on the spar. This effect is even more pronounced in the prior art method and apparatus for attaching the booms to the spar shown in the patent to Schweitzer noted above.

The present invention relates to a boom fitting which is more easily tightenable through the use of a lashing line and which has the surfaces of the boom receiving members which contact the spar coated with a resilient foam material, e.g., polyurethane foam with a texturized outer surface to reduce or eliminate the tendency of the booms to become cocked on the spar. More particularly, the present invention relates to a spar-end boom fitting comprising a first and a second boom receiving member each having a boom receiving bore therein and each being joined by a connecting member, with the connecting member forming with the boom receiving members a spar receiving indentation, and with the connecting member having a first and second lashing line passage therethrough. A jam cleat is formed radially along the outer circumference of one of the boom receiving members, including a groove, having a pair of opposed rows of teeth. Further, the spar receiving indentation is covered with a resilient foam material, e.g., polyurethane foam having a texturized outer surface, which will conform to the shape of the spar when the spar-end boom fitting is tightened to the spar.

In addition, the spar-end boom fitting of the present invention eliminates the need for knotting an up-haul line to a D-ring on the boom fittings of the prior art. The up-haul line is for assisting in erecting a fallen spar from the water when the user of the vehicle releases the boom allowing the spar and sail to fall into the water. The present invention provides an up-haul line passage through the connecting member which is tapered toward the center thereof and also a locking pin which fits into the tube-like center of the up-haul line and, in conjunction with the tapered surface of the up-haul line passage, locks the up-haul line within the passage.

Examples of the more important features of the present invention have thus been summarized rather broadly in order that the detailed description thereof that follows may be better understood, and in order that contribution to the art may be better appreciated. There are, of course, additional features of the invention that will be described hereinafter and which will also form the subject of the appended claims. These other features and advantages of the present invention will become more apparent with reference to the following detailed description of a preferred embodiment thereof in connection with the accompanying drawings, wherein the like reference numerals have been applied to like elements, in which:

DETAILED DESCRIPTION OF A PREFERRED EMBODIMENT

Figure 1:
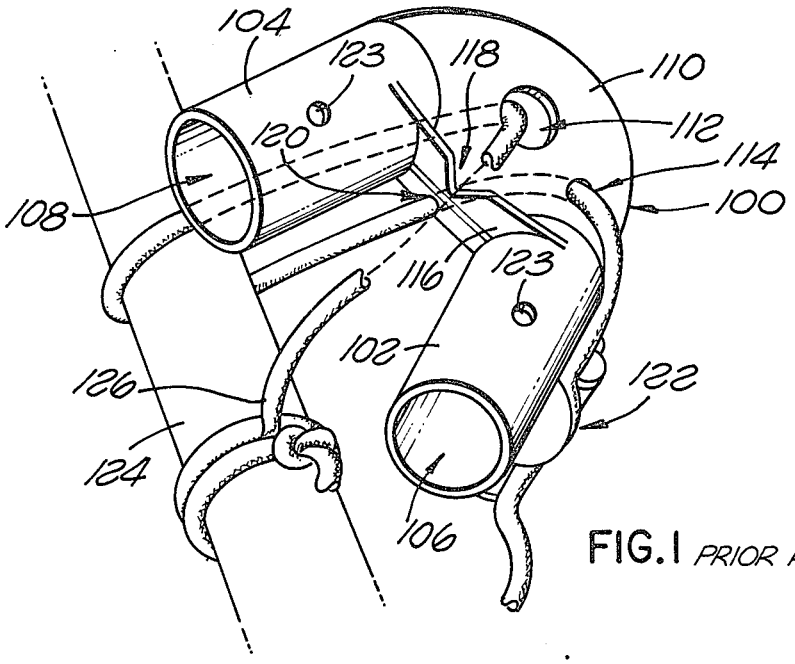
FIG. 1 PRIOR ART
FIG. 1 shows a perspective view of a prior art spar-end boom fitting.

Turning now to FIG. 1, a prior art spar-end boom fitting 100 is shown to include the first cylindrical boom receiving member 102 and the second cylindrical boom receiving member 104, each having a cylindrical boom receiving bore 106, 108 therein. The boom receiving members 102, 104 are joined by a thin generally D-shaped connecting member 110 which is relatively thin in comparison to the diameters of the boom receiving members 102, 104, and includes a large centrally located lashing line passage 112 and a smaller offset lashing line passage 114 aligned with the longitudinal axis of the boom receiving member 102. A connecting member brace 116 perpendicular to the connecting member 110 joins the boom receiving members 102, 104 approximately around one-half the circumferences thereof, and has a lashing line groove 118 and a lashing line passage 120. Formed along the outer surface of the boom receiving member 102 is a jam cleat 122 extending longitudinally along the outer surface of the boom receiving member 102.

In operation the prior art spar-end boom fitting shown in FIG. 1 attaches the booms, which are inserted in the boom receiving bores 106, 108 and fixed therein by the insertion of a pin (not shown) into the holes 123 and through a corresponding hole (not shown) on each of the booms, to the spar 124 by a lashing line 126 which is made fast to the spar 124 and passed through the lashing line passage 112, looped around the spar 124, and passed through the lashing line passages 120 and 114, and made fast in the jam cleat 122, with the lashing line being pulled as tightly as possible through the jam cleat 122 to tighten the spar-end boom fitting 100 to the spar 124.

Figure 2:
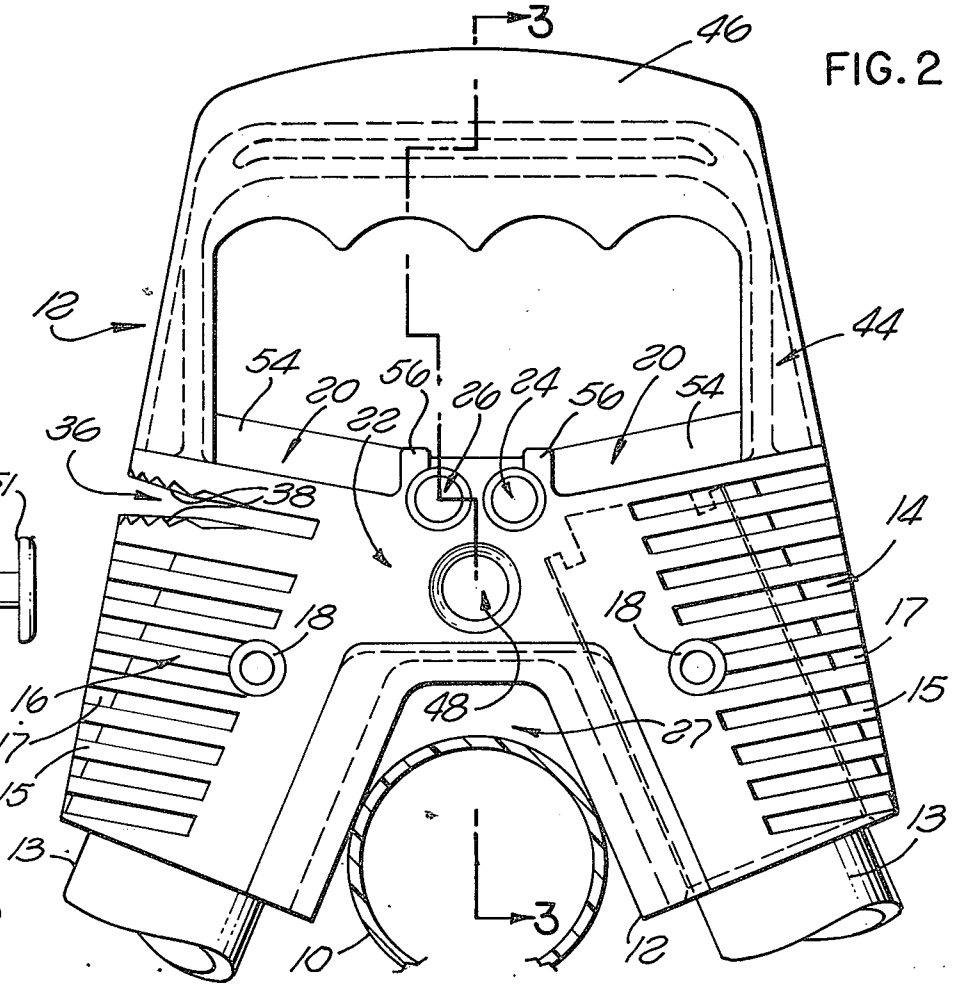
FIG. 2 shows a plan view of the spar-end boom fitting according to the present invention.

Turning now to FIG. 2, the spar-end boom fitting 12 according to the present invention, is shown in place against the spar 10 shown in cross section. The spar-end boom fitting 10 is formed of a suitable rigid plastic material, e.g., molded nylon. The spar-end boom fitting 12 includes a first generally cylindrical boom receiving member 14 having a bore therein into which the end of the boom 13 is inserted and a second generally cylindrical boom receiving member 16 having a bore into which a second boom 13 is inserted. A plurality of generally radially outward extending ribs 15 extend outwardly from the outer surface of each of the boom receiving members 14, 16 and are interconnected by a longitudinally outward extending spine 17, with the ribs 15 and spine 17 providing further structural support for the boom receiving members 14, 16. A pin 18 is inserted through a hole (not shown) in each of the boom receiving members 14, 16 and passes through a similar hole (not shown) in the respective boom 13 to hold the boom 13 within the bore of each of the respective boom receiving members 14, 16. The ends 20 of the boom receiving members 14, 16, opposite from the open end of the bore in each of the boom receiving members 14, 16 are closed. The closed ends 20 of the boom receiving members 14, 16 are joined by a connecting member 22 which is generally equilateral trapezoidal in shape and has a thickness approximately equal to the outer diameter of each of the boom receiving members 14, 16. The connecting member 22 has a pair of lashing line passages 24, 26 extending therethrough in a direction generally perpendicular to the longitudinal axis of each of the boom receiving members 14, 16. The boom receiving members 14, 16 and the connecting member 22 form a spar receiving indentation 27 which is generally U-shaped having diverging legs. A reinforcing ridge 19 extends along the sides of the boom receiving members 14, 16 and the connecting member 22 which form the spar receiving indentation 27.

A jam cleat 36 is formed radially along an arc of the circumference of the outer surface of the boom receiving member 16 and consists of a groove having a pair of opposed rows of teeth 38, with the jam cleat 36, being tapered in a direction toward the connecting member 22. The closed ends 20 of the boom receiving members 14, 16 are connected by a generally U-shaped handle 44 (shown in phantom in FIG. 2) which may conveniently be covered with a resilient foam, e.g., polyurethane foam padding 46.

Figure 3:
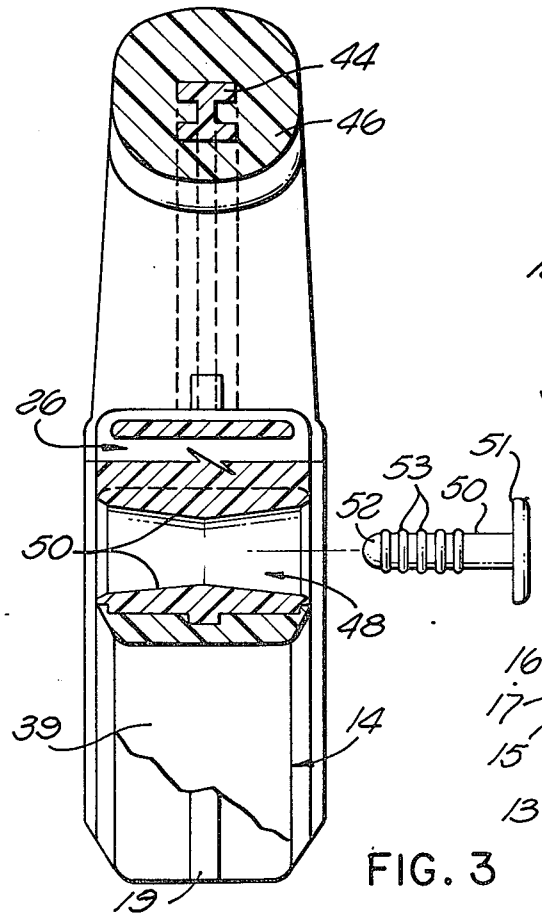
FIG. 3 shows a cross sectional view along lines 3—3 of FIG. 2 and includes the up-haul line locking pin according to the present invention.

The connecting member 22 also has a up-haul line locking mechanism bore 48 therethrough, which, as shown in more detail in FIG. 3, tapers inwardly towards the middle of the bore, having a tapering inner surface 50 forming a point of narrowest inner diameter toward the middle of the bore 48. A resilient plastic foam material, e.g., polyurethane foam, 39 covers the region of the boom receiving members 14, 16 and connecting member 22 which form the spar receiving indentation 27 and forms a cushion for the spar 10. The resilient foam material 39 is of a material which will conform to the shape of the spar 10 when the boom fitting 12 is tightened onto the spar 10 with the lashing line (not shown) in a manner similar to that of the prior art lashing shown in FIG. 1.

Turning now to FIG. 3, a cross sectional view along lines 3—3 of FIG. 2 is shown. The up-haul line locking mechanism bore 48 is shown to have an inside wall 50 which is tapered to form at the middle of the bore 48 a point of narrowest inner diameter of the bore 48. An up-haul line locking mechanism pin 50 is shown to have an anular ring 51 which abuts the connecting member 22 when the pin 50 is inserted in the bore 48 and to be of a length such that the tip 52 of the pin 50 will extend beyond the point of narrowest inner diameter of the bore 48 when the pin 50 is fully inserted into the bore 48. A plurality of anular ridges 53 are formed on the surface of the pin 50 and extend along the surface of the pin 50 from generally the tip 52 thereof to a point on the pin 50 which is on the opposite side of the point of narrowest diameter of the bore 48 from the tip 52 of the pin when the pin 50 is fully inserted in the bore 48.

Figure 4:
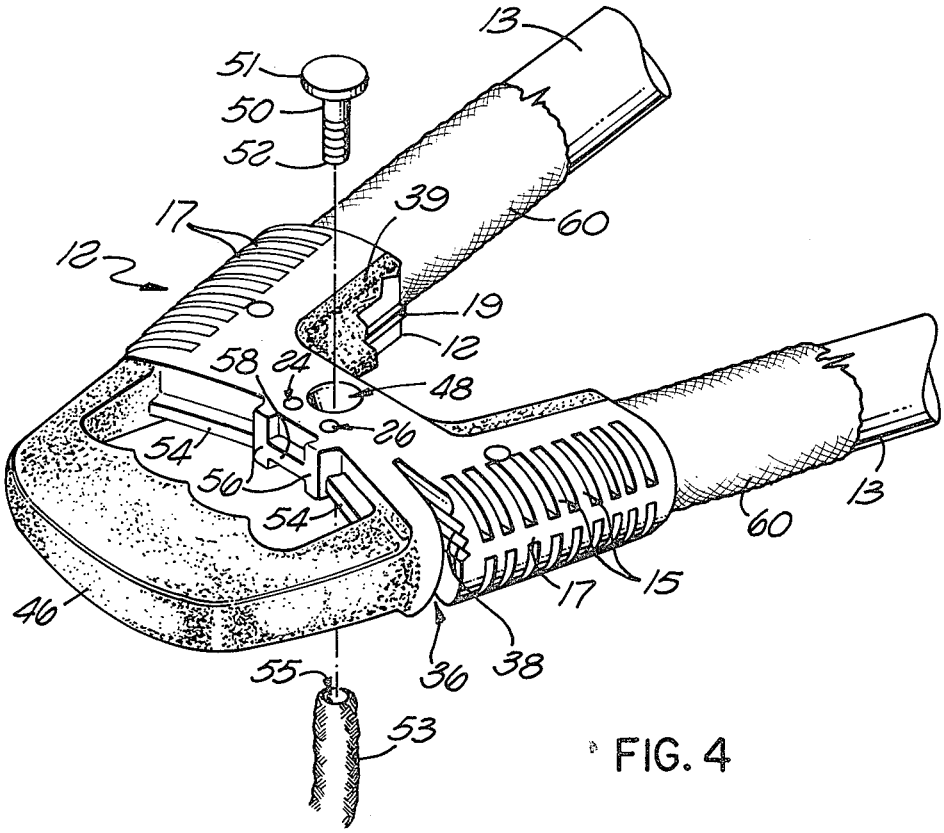
FIG. 4 shows a perspective view of the spar-end boom fitting according to the present invention, and including the up-haul line locking pin and mechanism according to the present invention.

Turning now to FIG. 4, the operation of the up-haul line locking mechanism is shown in more detail with the up-haul line 53 being shown to be constructed of a suitable material, e.g., nylon, having a weave which forms a tube leaving a longitudinal opening 55 through the center of the up-haul line 53. The up-haul line 53 is drawn through the bore 48 and the pin 50 inserted into the tubular passage 55. The up-haul line is then pulled in the opposite direction through the bore 48 until the anular ring 51 abuts the connecting member 22. The outer diameter of the pin 50 is of sufficient size that the up-haul line will be engaged and held between the pin 50 and point of narrowest diameter of the bore 48. The ridges 52 on the pin 50 serve to increase the frictional engagement of the up-haul line 53 between the pin 50 and the point of narrowest diameter of the bore 48. The up-haul line 53 will thus be held in the bore 48 without the need for any knotting of the up-haul line 53.

FIG. 4 also shows an optional neoprene rubber coating 60 on each of the booms 13 which is cut away to show the boom 13. The neoprene cover 60 may extend the length of the boom or along sections of the boom to facilitate the gripping of the boom by the user of the vehicle. In addition, FIG. 4 shows transverse support ridges 54 extending outwardly from the closed ends of the boom receiving members 14, 16 and aligned with the longitudinal center line axis of the boom receiving members 14, 16. In addition, a pair of elevational support ridges 56 and a transverse support ridge 58 provide for structural support for the end of the connecting member 22 and the closed ends 20 of the boom-receiving members 14, 16. The spar-end boom fitting 12 is conveniently fabricated from two generally identical pieces of molded plastic, e.g., nylon, and joined along a seam running through the ridges 15, 19, 54 and 56 and through the handle 44. The only difference between the two pieces is the tapered part of the jam cleat 36 containing the teeth 38 will be formed on one half, while the other half will have a outwardly tapering flat groove which forms the terminal end of the jam cleat 36. The resilient foam covering 39 over the spar receiving indentation 27 and the foam covering 46 over the handle 44 are then placed on the spar-end boom fitting 10 in any convenient manner, e.g., with adhesive or a foam casting.

SUMMARY OF THE ADVANTAGES AND SCOPE OF THE INVENTION

It will be appreciated that in constructing a spar-end boom fitting according to the present invention having an up-haul line locking mechanism according to the present invention, certain significant advantages are provided.

In particular the jam cleat being formed radially on an arc of the circumference of one of the boom receiving members facilitates the tightening of the spar-end boom fitting to the spar, using a lashing line as was known in the prior art. The resilient foam surface on the surfaces of the spar-end boom fitting in the region of the spar receiving indentation, which conforms to the shape of the spar at points of contact with the spar, when the spar-end boom fitting is tightened to the spar, facilitates the prevention of cocking of the spar during movement of the booms to control the speed and direction of the vehicle. The up-haul line locking mechanism provides for a firm gripping of the up-haul line without the need to knot the up-haul line.

The foregoing description of the invention has been directed to a particular preferred embodiment in accordance with the requirements of the patent statutes and for purposes of explanation and illustration. It will be apparent, however, to those of ordinary skill in this art that many modifications and changes in both the apparatus and method of the present invention may be made without departing from the scope and spirit of the invention. These modifications of the invention will be apparent to those skilled in the art. It is the applicant's intention in the following claims to cover all such equivalent modifications and variations as fall within the true spirit and scope of the invention.

What is claimed is:

1. A spar-end boom fitting, comprising:

a first boom receiving member having a boom receiving bore therein;

a second boom receiving member having a boom receiving bore therein, each boom receiving member having a plurality of parallel ribs extending radially outward from at least a portion of the boom receiving member and interconnected by a spine extending longitudinally from the boom receiving member;

a connecting member connecting the first and second boom receiving members and forming therewith a spar receiving identation in the spar-end boom fitting;

a first and a second lashing line passage through the connecting member, and, a jam cleat formed radially about the circumference of one of the first and second boom receiving members, and including a tapered groove formed between a pair of the ribs of one of the first and second boom receiving members, said groove having a pair of opposed rows of teeth.

2. The apparatus of claim 1 wherein the spar receiving indentation is covered with a resilient foam material which will conform to the shape of the spar at any region of the spar receiving indentation contacted by the spar.

3. A spar-end boom fitting comprising:

a first cylindrical boom receiving member having an open end and a closed end, and having an outer surface, an outer diameter, and a longitudinal axis;

a second cylindrical boom receiving member having an open end and a closed end and having an outer surface, an outer diameter, and a longitudinal axis, each boom receiving member having a plurality of parallel ribs extending radially outward from at least a portion of the outer surface of each boom receiving member and interconnected by a spine extending longitudinally outward from the outer surface of each boom receiving member;

a connecting member connecting the first and second boom receiving members at the closed ends thereof and having a thickness substantially equal to the outer diameter of each of the first and second boom receiving members and forming with the first and second boom-receiving members a spar-receiving indentation;

a pair of lashing line passages extending through the connecting member generally perpendicularly to the longitudinal axis of each of the first and second boom receiving members; and, a jam cleat formed radially about a portion of the outer surface of one of the first and second boom receiving members at the closed end thereof and including a tapered groove formed between a pair of the ribs and extending about the portion of the outer surface of the respective one of the first and second boom receiving members, said groove having a pair of opposed rows of teeth.

4. The apparatus of claim 3 wherein the spar receiving indentation is covered with a resilient foam material which will conform to the shape of the spar at any region of the spar receiving indentation contacted by the spar.

5. The apparatus of claim 1 or 2 or 3 or 4 further comprising:

an up-haul line locking mechanism including a bore formed through the connecting member, having an inner surface which tapers to a narrower diameter toward the longitudinal center of the bore, and including also a locking pin having an annular flange which abuts the connecting member when the locking pin is inserted into the bore and a length sufficient to extend beyond the point of narrowest diameter of the bore;

the locking pin having an outer diameter of sufficient size to engage and lock an up-haul line between the locking pin and the point of minimum diameter of the bore, when the up-haul line is inserted through the bore in one direction, the locking pin is inserted between the strands of the up-haul line along the longitudinal axis of the up-haul line, and the locking pin is then pulled into the bore by pulling the up-haul line through the bore in a direction opposite to the one direction.

6. The appartus of claim 1 or 2 or 3 or 4 further comprising:

an up-haul line locking mechanism including a bore formed through the connecting member, having an inner surface which tapers to a narrower diameter toward the longitudinal center of the bore, and including also a locking pin having an annular flange which abuts the connecting member when the locking pin is inserted into the bore and a length sufficient to extend beyond the point of narrowest diameter of the bore;

the locking pin having an outer diameter of sufficient size to engage and lock an up-haul line between the locking pin and the point of minimum diameter of the bore, when the up-haul line is inserted through the bore in one direction, the locking pin is inserted between the strands of the up-haul line along the longitudinal axis of the up-haul line, and the locking pin is then pulled into the bore by pulling the up-haul line through the bore in a direction opposite to the one direction; and, the locking pin has a plurality of annular ridges on the terminal end of the pin, extending from the tip of the pin to a point on the opposite side of the point of narrowest diameter in the bore, from the tip of the pin, when the pin is fully inserted into the bore.

* * * * *